US010113329B2

(12) United States Patent
Choi

(10) Patent No.: US 10,113,329 B2
(45) Date of Patent: Oct. 30, 2018

(54) EAVE STRUCTURE AND TENT FRAME HAVING SAME

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/821,019

(22) Filed: Nov. 22, 2017

(65) Prior Publication Data

US 2018/0142493 A1 May 24, 2018

(30) Foreign Application Priority Data

Nov. 24, 2016 (CN) ..... 2016 2 1265580

(51) Int. Cl.
*E04H 15/50* (2006.01)
*E04H 15/46* (2006.01)

(52) U.S. Cl.
CPC ..... *E04H 15/50* (2013.01); *E04H 15/46* (2013.01)

(58) Field of Classification Search
CPC ..... E04H 15/32; E04H 15/34; E04H 15/44; E04H 15/46; E04H 15/48; E04H 15/50
See application file for complete search history.

(56) References Cited

U.S. PATENT DOCUMENTS 1,061,547 A 5/1913 Kennedy
1,347,107 A 7/1920 McCann
3,888,056 A 6/1975 Kelly
4,286,612 A 9/1981 Neal
4,630,627 A 12/1986 Windows
4,641,676 A 2/1987 Lynch
4,793,371 A 12/1988 O'Ferrell
4,944,321 A 7/1990 Moyet-Ortiz
5,224,507 A 7/1993 Vosse
5,275,188 A 1/1994 Tsai
5,421,356 A 6/1995 Lynch
5,794,640 A 8/1998 Jang
5,813,425 A 9/1998 Carter
5,944,040 A 8/1999 Jang
6,182,917 B1 2/2001 Lai
(Continued)

FOREIGN PATENT DOCUMENTS

CA 2895981 A1 * 12/2015 ..... E04H 15/50
CN 2401649 Y 10/2000
(Continued)

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed are eave structures and tent frames with the same. An eave structure includes a sleeve member, an eave pole, a connecting pole and a sliding connector. For a tent frame having a first connector on a supporting pole and an upper pole, the sleeve member is to be disposed at the first connector, and the sliding connector is to be slidably coupled with and movable along the upper pole. The eave pole is slidably coupled with the sleeve member. The connecting pole has a first end portion pivotally connected with a first end portion of the eave pole and a second end portion pivotally connected with the sliding connector.

20 Claims, 9 Drawing Sheets

(56) References Cited

U.S. PATENT DOCUMENTS

| | | | | |
|---|---|---|---|---|
| 6,206,020 | B1 | 3/2001 | Lynch | |
| 6,463,948 | B2 | 10/2002 | Lee | |
| 6,598,614 | B2 | 7/2003 | Liu | |
| 6,708,707 | B2 | 3/2004 | Dotterweich | |
| 6,718,995 | B2 | 4/2004 | Dotterweich | |
| 6,848,461 | B2 | 2/2005 | Tsai | |
| 6,929,017 | B2 | 8/2005 | Byun | |
| 7,055,538 | B2 | 6/2006 | Deng | |
| 7,240,686 | B2 | 7/2007 | Seo | |
| 7,296,584 | B2 | 11/2007 | Goldwitz | |
| 7,299,813 | B2 | 11/2007 | Ochi | |
| 7,316,239 | B2 | 1/2008 | Yang | |
| 7,360,549 | B2 | 4/2008 | Seo | |
| 7,395,830 | B2 | 7/2008 | Seo | |
| 7,422,026 | B2 | 9/2008 | Kim | |
| 8,220,477 | B2 | 7/2012 | Park | |
| 8,544,489 | B2 | 10/2013 | Choi | |
| 8,616,226 | B2 | 12/2013 | Ma | |
| 8,701,692 | B2 | 4/2014 | Holland | |
| D705,884 | S | 5/2014 | Jin | |
| 8,776,816 | B2 | 7/2014 | Danziger | |
| 8,893,737 | B2 | 11/2014 | Yang | |
| 8,910,648 | B2 | 12/2014 | Jin | |
| 9,243,422 | B2 | 1/2016 | Hunt | |
| 9,528,292 | B1 * | 12/2016 | Lovley, II | E04H 15/48 |
| 9,580,929 | B2 | 2/2017 | Ma | |
| 9,739,073 | B2 * | 8/2017 | Huang | E04H 15/50 |
| 9,869,110 | B2 | 1/2018 | Krenzel | |
| 9,926,720 | B2 | 3/2018 | Huang | |
| 2001/0050098 | A1 | 12/2001 | Lee | |
| 2004/0144412 | A1 | 7/2004 | Tsai | |
| 2005/0241688 | A1 | 11/2005 | Wu | |
| 2006/0169312 | A1 | 8/2006 | Choi | |
| 2007/0012347 | A1 | 1/2007 | Ochi | |
| 2007/0051397 | A1 * | 3/2007 | Choi | E04H 15/50 135/131 |
| 2007/0144572 | A1 | 6/2007 | Patel | |
| 2007/0221262 | A1 * | 9/2007 | Tsai | E04H 15/50 135/145 |
| 2009/0032079 | A1 | 2/2009 | Choi | |
| 2010/0043856 | A1 * | 2/2010 | Park | E04H 15/50 135/145 |
| 2011/0073148 | A1 * | 3/2011 | Choi | E04H 15/50 135/145 |
| 2012/0291830 | A1 | 11/2012 | Crimi | |
| 2013/0014794 | A1 | 1/2013 | Jin | |
| 2013/0247948 | A1 | 9/2013 | Lovely et al. | |
| 2013/0284225 | A1 * | 10/2013 | Holland | E04H 15/46 135/139 |
| 2014/0174491 | A1 * | 6/2014 | Yang | E04H 15/48 135/144 |
| 2014/0261601 | A1 | 9/2014 | Jin | |
| 2014/0261602 | A1 | 9/2014 | Ampoyo | |
| 2014/0290710 | A1 | 10/2014 | Choi | |
| 2015/0083177 | A1 | 3/2015 | Hotes | |
| 2015/0247339 | A1 | 9/2015 | Lee | |
| 2015/0308147 | A1 | 10/2015 | Lee | |
| 2015/0376913 | A1 | 12/2015 | Choi | |
| 2016/0108639 | A1 | 4/2016 | Huang | |
| 2016/0348392 | A1 | 12/2016 | Jin | |
| 2017/0121999 | A1 * | 5/2017 | Ma | E04H 15/50 |
| 2017/0292287 | A1 * | 10/2017 | Lovley, II | E04H 15/50 |
| 2018/0080242 | A1 | 3/2018 | Choi | |
| 2018/0080243 | A1 | 3/2018 | Choi | |
| 2018/0106066 | A1 | 4/2018 | Choi | |
| 2018/0106067 | A1 | 4/2018 | Choi | |
| 2018/0106068 | A1 | 4/2018 | Choi | |
| 2018/0142493 | A1 | 5/2018 | Choi | |

FOREIGN PATENT DOCUMENTS

| | | | |
|---|---|---|---|
| CN | 201202302 | Y | 3/2009 |
| CN | 103590650 | B | 2/2014 |
| CN | 104265063 | A | 1/2015 |
| CN | 104358468 | A | 2/2015 |
| CN | 204163467 | U | 2/2015 |
| FR | 1 121 851 | | 8/1956 |
| FR | 68588 | | 5/1958 |
| JP | 4557885 | B2 | 10/2010 |
| WO | WO 2010/104939 | A1 | 9/2010 |
| WO | WO 2011/022764 | A1 | 3/2011 |
| WO | WO 2013/116545 | A1 | 8/2013 |

* cited by examiner

EAVE STRUCTURE AND TENT FRAME HAVING SAME

CROSS-REFERENCE(S) TO RELATED APPLICATION

The present application claims priority to Chinese Patent Application No. 201621265580.8, filed on Nov. 24, 2016, the entire contents of which are incorporated herein for all purposes by this reference.

FIELD OF THE INVENTION

The present disclosure relates to tent frames, and, more particularly, the present disclosure relates to eave structures and tent frames having the same.

BACKGROUND

In general, tents are available in a variety of sizes and structures. Small to medium sized tents are typically utilized for mobility and camping, while larger pavilion sized tents provide large shaded regions.

Conventional tents comprise supporting poles, an upper frame supported by the supporting poles, and a tent cloth covering the upper frame. The given shaded region of the tent is proportional to an area formed by the tent cloth. Increasing the shaded region requires an enlargement of the tent frame, including increasing a length of the frame poles. The increased size of the frame poles requires auxiliary support to ensure the stability of the tent, thus a weight of the tent increases.

Another means to provide a larger shading area is to design a tent or tent frame with an eave supporting frame. For instance, FIG. 1 and FIG. 2 illustrate an existing tent including eave supporting frame 4' provided at each supporting pole 1'. Eave supporting frame 4' includes eave main pole 41' and eave auxiliary pole 42'. One end of eave main pole 41' is pivotally connected with fixed seat 11' at a top end of the supporting pole 1' and the other end is connected with an outer side of a tent cloth. One end of eave auxiliary pole 42' is pivotally connected with sliding block 43' slidably coupled with supporting pole 1'. The other end of eave auxiliary pole 42' is pivotally connected with eave main pole 41'.

However, to realize synchronous folding of the eave supporting frame and the upper frame, upper frame 2' is pivotally connected with sliding seats 12' of supporting poles 1'. Sliding seat 12' usually includes a plastic. To enable the pivotal connection of the upper frame, sliding seat 12' needs to have a U-shaped mouth to accommodate the upper frame (e.g., a pole of the upper frame), and additional processing is required to make the U-shaped mouth. As a result, manufacturing costs increase. In addition, the configuration of sliding seat 12' is too specific, and thus it is difficult to adopt sliding seat 12' for use in other tents.

Moreover, the configuration of eave supporting frame 4' with two poles (main and auxiliary poles) and the sliding block increases the total number of poles and elements needed for making a tent frame. The above configuration also makes the structure of the tent frame relatively complex, further increasing the size of the tent frame when folded.

Thus, prior to the present disclosure there existed a need for eave structures and tent frames that address the above-mentioned issues.

The information disclosed in this Background of the Invention section is only for enhancement of understanding of the general background of the invention and should not be taken as an acknowledgement or any form of suggestion that this information forms the prior art already known to a person skilled in the art.

SUMMARY OF THE INVENTION

Advantageously, the eave structures and tent frames having the same detailed in the present disclosure address the shortcomings in the prior art detailed above.

Various aspects of the present disclosure are directed to providing eave structures and tent frames having the same. In many embodiments, an eave structure is for a tent frame comprising a supporting pole, a first upper pole, and a second upper pole. The eave structure comprises a sleeve member configured to be disposed at a first connector of the tent frame. An eave pole is slidably coupled with the sleeve member, and a connecting pole has a first end portion pivotally connected with a first end portion of the eave pole and a second end portion pivotally connected with a sliding connector. The sliding connector is slidably coupled with the first upper pole and movable along the first upper pole. Furthermore, a first end portion of the first upper pole is pivotally connected with a hub of the tent frame, and a second end portion of the first upper pole is pivotally connected with a first end portion of the second upper pole. Additionally, a second end portion of the second upper pole is pivotally connected with a first connector fixedly coupled with an upper end portion of the supporting pole.

In some embodiments, the sliding connector comprises a through hole configured to allow the first upper pole to penetrate therethrough. A pivoting seat comprising a pivoting groove is formed on a surface of the sliding connector, such that the second end portion of the connecting pole is pivotally disposed in the pivoting groove of the pivoting seat.

In some embodiments, the pivoting seat is formed on a surface of the sliding connector, and the second end portion of the connecting pole is pivotally connected to an external side of the pivoting seat.

In some embodiments, the sliding connector comprises at least one convex surface, and the pivoting seat is formed on the at least one convex surface of the sliding connector.

In some embodiments, the sleeve member is formed with a through hole through which the second end portion of the eave pole passes therethrough.

In some embodiments, the sleeve member is fixedly coupled with or integrally formed with the first connector at a top of the first connector.

In some embodiments, a middle portion of the connecting pole is pivotally connected with the second upper pole at a position between the first and second end portions of the second upper pole.

In many embodiments, the present invention provides a tent frame comprising a plurality of supporting poles, a plurality of side pole units, an upper frame, and two or more eave structures of the present invention disclosed herein.

Each supporting pole in the plurality of supporting poles is provided with a first connector and a second connector. The first connector is fixedly coupled with an upper end portion of the supporting pole, and the second connector is slidably coupled with the supporting pole and movable along the supporting pole below the first connector. Furthermore, each side pole unit in the plurality of side pole units is coupled with two adjacent supporting poles through one or more of the first and second connectors at the two adjacent supporting poles and is disposed at a side of the tent frame between the two corresponding adjacent supporting poles when the tent frame is in an unfolded state.

The upper frame is coupled with the plurality of supporting poles, the plurality of side pole units, or both, and comprises a hub, a plurality of upper pole units, and a plurality of oblique poles.

Each eave structures corresponds to a supporting pole in a subset of the plurality of supporting poles, and comprises a sleeve member, an eave pole, a connecting pole, and a third connector.

Corresponding to each respective supporting pole in the plurality of supporting poles, an upper pole unit in the plurality of upper pole units comprises a first upper pole and a second upper pole, each having first and second end portions. The first end portion of the first upper pole is pivotally connected with the hub, and the second end portion of the first upper pole is pivotally connected with the first end portion of the second upper pole. Furthermore, the second end portion of the second upper pole is pivotally connected with the first connector. Furthermore, each oblique pole has a first end portion pivotally connected with the second upper pole at a position between the first and second end portions thereof, and a second end portion pivotally connected with the second connector.

Additionally, corresponding to each respective supporting pole in the subset of the plurality of supporting poles, the sleeve member is disposed at the first connector at the respective supporting pole, and the eave pole is slidably coupled with the sleeve member at the respective supporting pole. The connecting pole has a first end portion pivotally connected with a first end portion of the eave pole and a second end portion pivotally connected with the third connector. The third connector is slidably coupled with and movable along the first upper pole of the upper pole unit connected with the respective supporting pole.

In some embodiments, a number of supporting poles and a number of eave structures are the same, and each respective supporting pole in the plurality of supporting poles has a corresponding eave structure.

In some embodiments, the third connector comprises a through hole configured to allow the first upper pole to penetrate therethrough. A pivoting seat comprising a pivoting groove is formed on a surface of the third connector, and the second end portion of the connecting pole is pivotally disposed in the pivoting groove of the pivoting seat.

In some embodiments, the pivoting seat is formed on a surface of the third connector, and, the second end portion of the connecting pole is pivotally connected to an external side of the pivoting seat.

In some embodiments, the third connector comprises at least one convex surface, and the pivoting seat is formed on the at least one convex surface of the third connector.

In some embodiments, the sleeve member is formed with a through hole through which the second end portion of the eave pole passes therethrough.

In some embodiments, the sleeve member is fixedly coupled with or integrally formed with the first connector.

In some embodiments, a middle portion of the connecting pole is pivotally connected with the second upper pole of the upper pole unit connected with the respective supporting pole at a position between the first and second end portions of the second upper pole.

In some embodiments, a side pole unit in the plurality of side pole units comprises one or more side pole pairs connected with each other, wherein each side pole pair comprises first and second side poles crossly and pivotally connected with each other, and each of the first and second side poles adjacent a supporting pole has an end portion pivotally connected with the first or second connector at the supporting pole. In an embodiment, each side pole unit in the plurality of side pole units comprises three side pole pairs.

Furthermore, in some embodiments, the tent frame includes a tent cloth coupled with and supported by the tent frame when the tent is unfolded.

The eave structures and tent frames of the present invention have other features and advantages that will be apparent from, or are set forth in more detail in the accompanying drawings, which are incorporated herein, and the following Detailed Description, which together serve to explain certain principles of the exemplary embodiments of the present invention.

Figure 1:
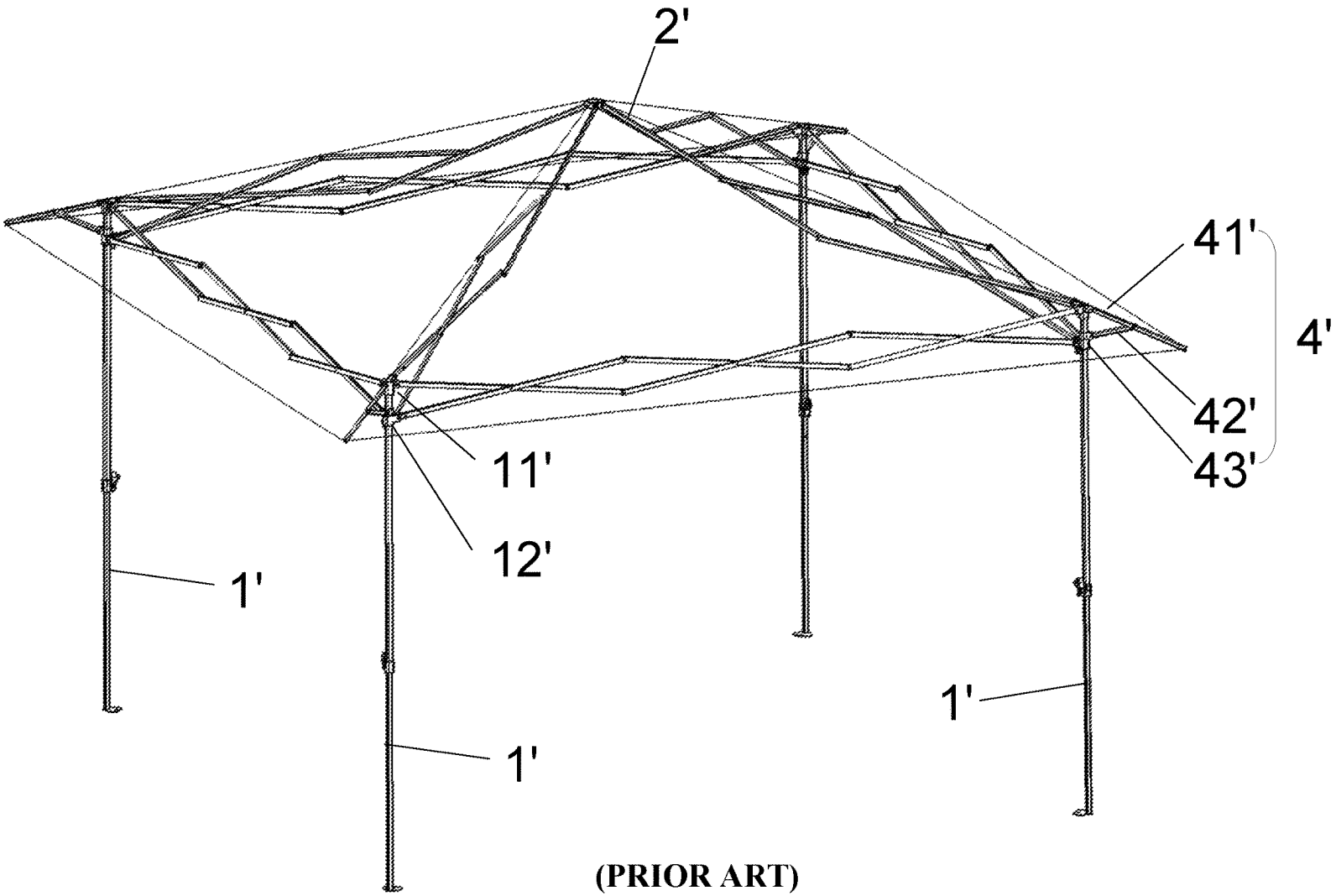
(PRIOR ART) FIG. 1
FIG. 1 is a schematic view illustrating a tent according to the prior art.
Figure 2:
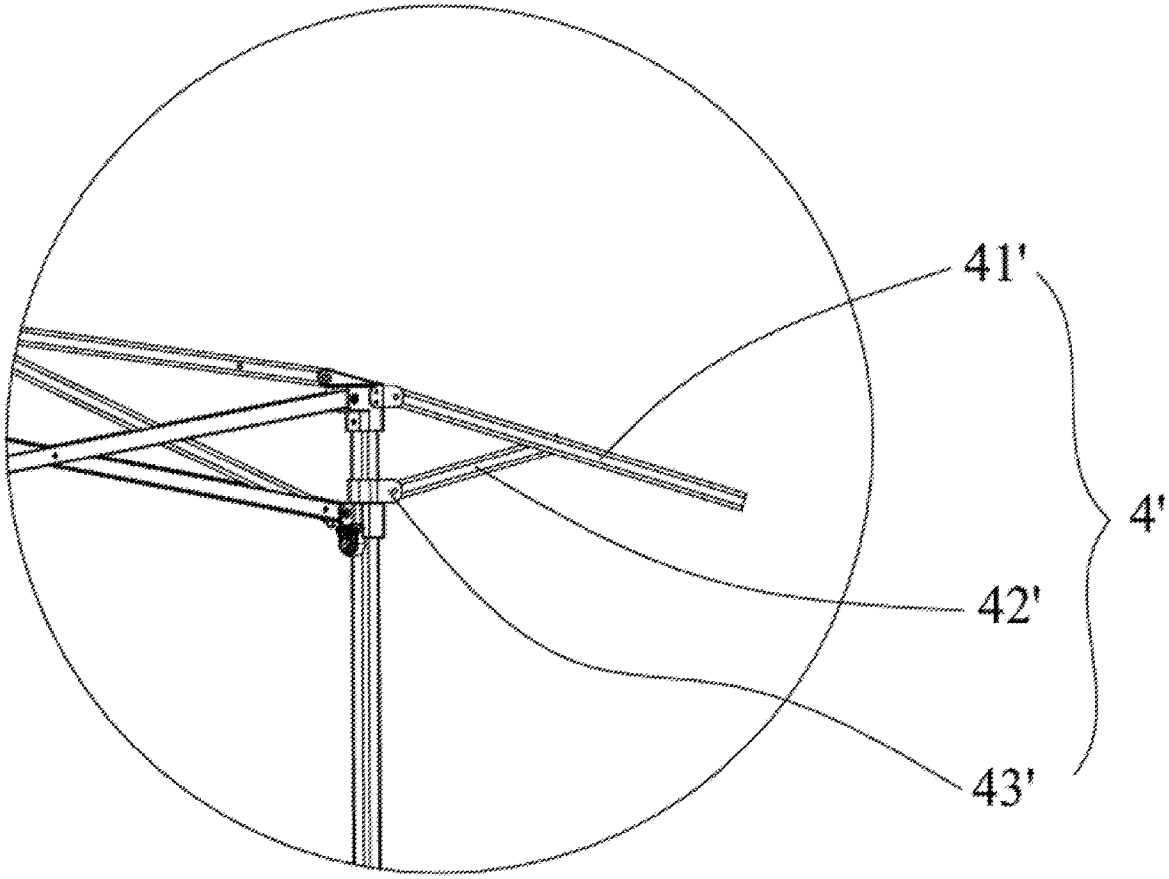
(PRIOR ART) FIG. 2
FIG. 2 is a schematic view illustrating an eave structure of FIG. 1.

It should be understood that the appended drawings are not necessarily to scale, and are intended for illustration of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will also be understood that, although the terms first, second, etc. may be used herein to describe various elements, these elements should not be limited by these terms.

These terms are only used to distinguish one element from another. For example, a first connector could be termed a second connector, and, similarly, a second connector could be termed a first connector, without departing from the scope of the present disclosure. The first connector and the second connector are both connectors, but they are not the same connector.

Furthermore, as used in the description of the implementations and the appended claims, the singular forms "a", "an", and "the" are intended to include the plural forms as well, unless the context clearly indicates otherwise.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Various aspects of the present disclosure are directed to providing eave structures and tent frames having such eave structures. Generally, a tent frame of the present invention includes a plurality of supporting poles, and a plurality of side pole units each disposed between and connected with adjacent supporting poles. A tent frame of the present invention also includes an upper frame connected with the plurality of supporting poles, the plurality of side pole units, or both. A tent frame of the present invention can be of various shapes and sizes, and can include any number of supporting poles such as three, four, five or more supporting poles.

A tent frame of the present invention further includes a plurality of eave structures, a number of which can be varied depending on an application, preference, and/or design thereof. For instance, a tent frame of the present invention can include two eave structures, three eave structures, or the same number of eave structures as supporting poles.

An eave structures usually includes an eave pole and a mechanism connecting the eave pole with the upper frame and one of the supporting poles. When the tent frame is unfolded, the eave pole extends beyond the upper frame and/or the supporting pole. Such an eave structure, along with other elements of the tent frame, can be used to support a tent cloth such as a canopy. When the eave pole extends beyond the upper frame and/or the supporting pole, the eave pole increases a shading area, and/or sheds rain or snow away from the tent.

Figure 3:
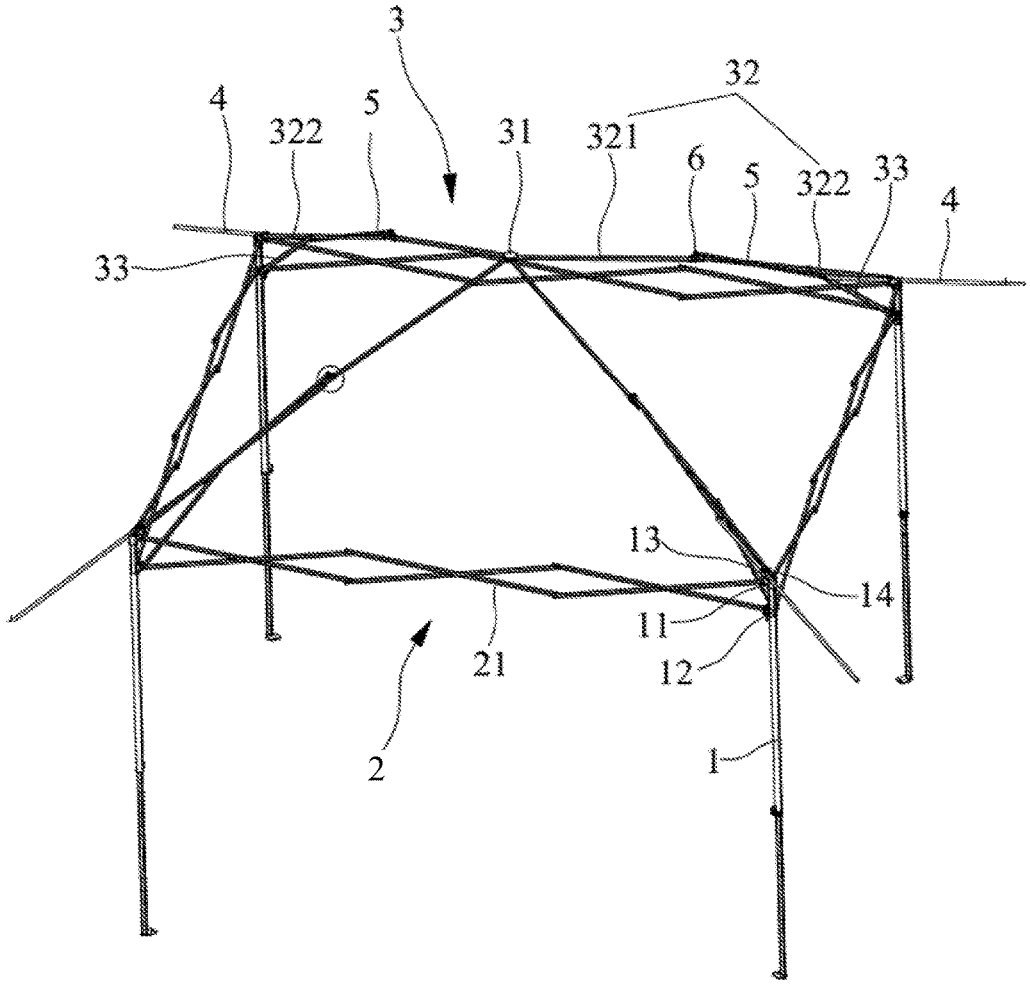
FIG. 3 is a schematic view illustrating a tent frame in an unfolded state according to an exemplary embodiment of the present invention.
Figure 7:
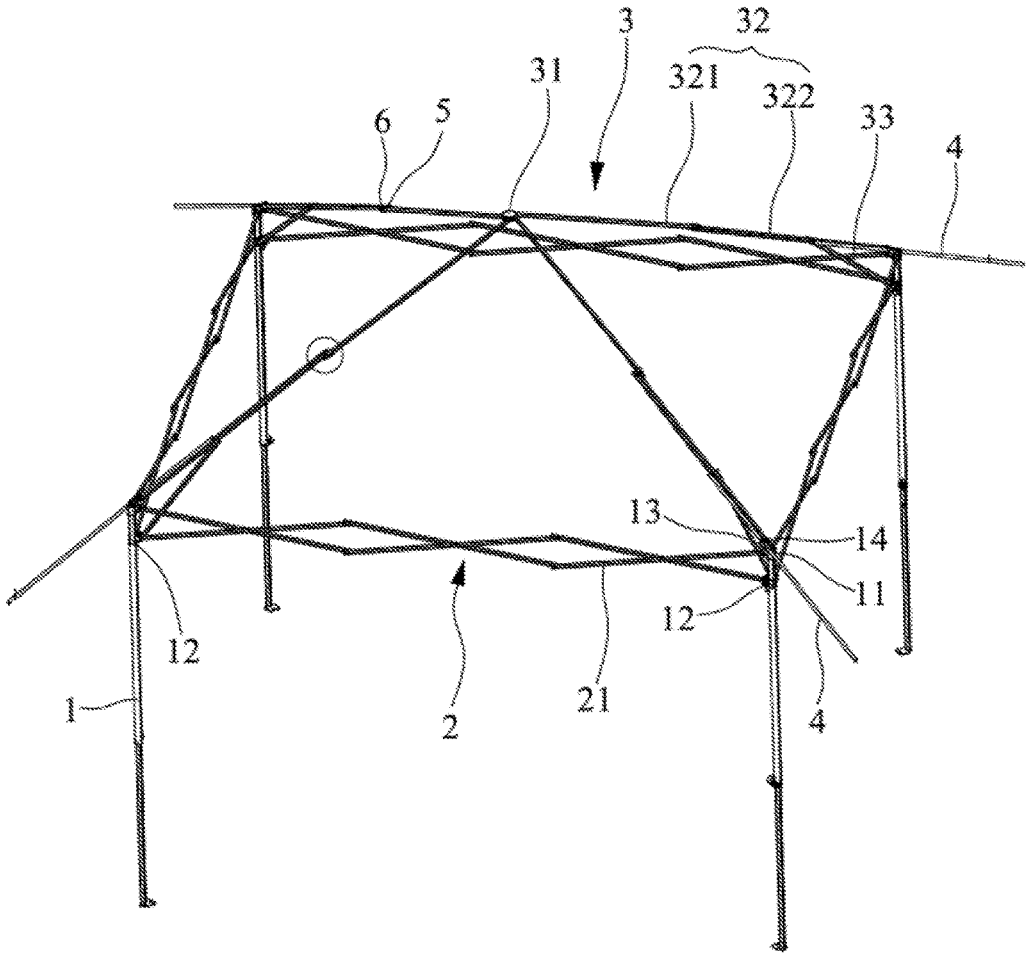
FIG. 7 is a schematic view illustrating a tent frame in an unfolded state according to another exemplary embodiment of the present invention.

Referring to FIG. 3 and FIG. 7, there are depicted exemplary tent frames in an unfolded state in accordance with exemplary embodiments of the present invention. As shown, a tent frame includes a plurality of supporting poles 1, having a plurality of first connectors 11 and a plurality of second connectors 12 disposed on the supporting poles to connect the supporting poles with other elements of the tent frame. In some embodiments, each first connector is fixedly coupled with a supporting pole at an upper end portion (e.g., a top) of the supporting pole. Each second connector is slidably coupled with a supporting pole and is movable along the supporting pole below the first connector. In the illustrated embodiments, the number of supporting poles is four, and the supporting poles collectively form an approximately square or rectangular shape when the tent frame is unfolded. In some embodiments, each supporting pole is extendable and retractable.

The tent frame also includes a plurality of side pole units connected with the plurality of supporting poles. When the tent frame is unfolded, each side pole unit is disposed on a side of the tent frame between two adjacent supporting poles. A side pole unit can have any suitable configuration, including, but not limited, to a pivotally connected side pole pair. Furthermore, among the plurality of side pole units, one side pole unit can have the same or different configuration as another side pole unit. For instance, one side pole unit can have two or more side pole pairs. In some embodiments, a side pole unit comprises two or more side pole pairs, each having first and second side poles crossly and pivotally connected with each other. Of any two adjacent side pole pairs, the first side pole of one side pole pair is pivotally connected with the second side pole of the other side pole pair at their adjacent end portions.

By way of example, FIG. 3 illustrates each side pole unit 2 including two side pole pairs 21, the first and second side poles of which are pivotally connected to each other at their adjacent end portions, respectively. In addition, of each side pole pair, one side pole has an end portion pivotally connected with first connector 11 disposed at one of the two adjacent supporting poles and the other end portion pivotally connected with second connector 12 disposed at the other of the two adjacent supporting poles.

The tent frame also includes an upper frame such as upper frame 3 coupled with the plurality of supporting poles, the plurality of side pole units, or both. Upper frame 3 is disposed above and supported by the plurality of supporting poles when the tent frame is unfolded. In some embodiments, upper frame 3 includes hub 31, a plurality of upper pole units 32, and a plurality of oblique poles 33. In some embodiments, each upper pole unit includes two or more upper poles pivotally connected with each other. Among the two or more upper poles, the upper pole adjacent the hub (referred herein as a first upper pole) has an end portion pivotally connected with the hub, and the upper pole adjacent the corresponding supporting pole (referred herein as a second upper pole) has an end portion pivotally connected with the first connector. The first and second upper poles are pivotally connected, directly or indirectly, with each other.

By way of example, FIG. 3 illustrates each upper pole unit includes two upper poles—first upper pole 321 and second upper pole 322, in which first upper pole 321 has an end portion pivotally connected with the hub and second upper pole 322 has an end portion pivotally connected with the first connector.

Each oblique pole 33 is connected with an upper pole unit, a side pole unit, or both. For instance, each oblique pole has a first end portion pivotally connected with an upper pole unit and a second end portion pivotally connected with a side pole unit. In some embodiments where the corresponding upper pole unit includes two or more upper poles, the first end portion of the oblique pole is pivotally connected with the second upper pole of the corresponding upper pole unit. Furthermore, in some embodiments, the first end portion of the oblique pole is pivotally connected with the second upper pole of the corresponding upper pole unit at a position in between a first end portion and a second end portion of the second upper pole. In some embodiments where the corresponding side pole unit includes one or more pairs of crossly and pivotally connected side poles, the second end portion of the oblique pole is pivotally connected with the side pole that has an end portion connected with second connector 12 at the corresponding supporting pole. In an embodiment, the second end portion of the oblique pole is pivotally connected with second connector 12 at the corresponding supporting pole.

The tent frame further includes two or more eave poles 4, and mechanisms to couple the eave poles with the upper frame and the supporting poles (the supporting poles or elements disposed at the supporting poles). Collectively, an eave pole and a mechanism to couple the eave pole with the upper frame and a supporting pole are referred herein as an eave structure.

Figure 4:
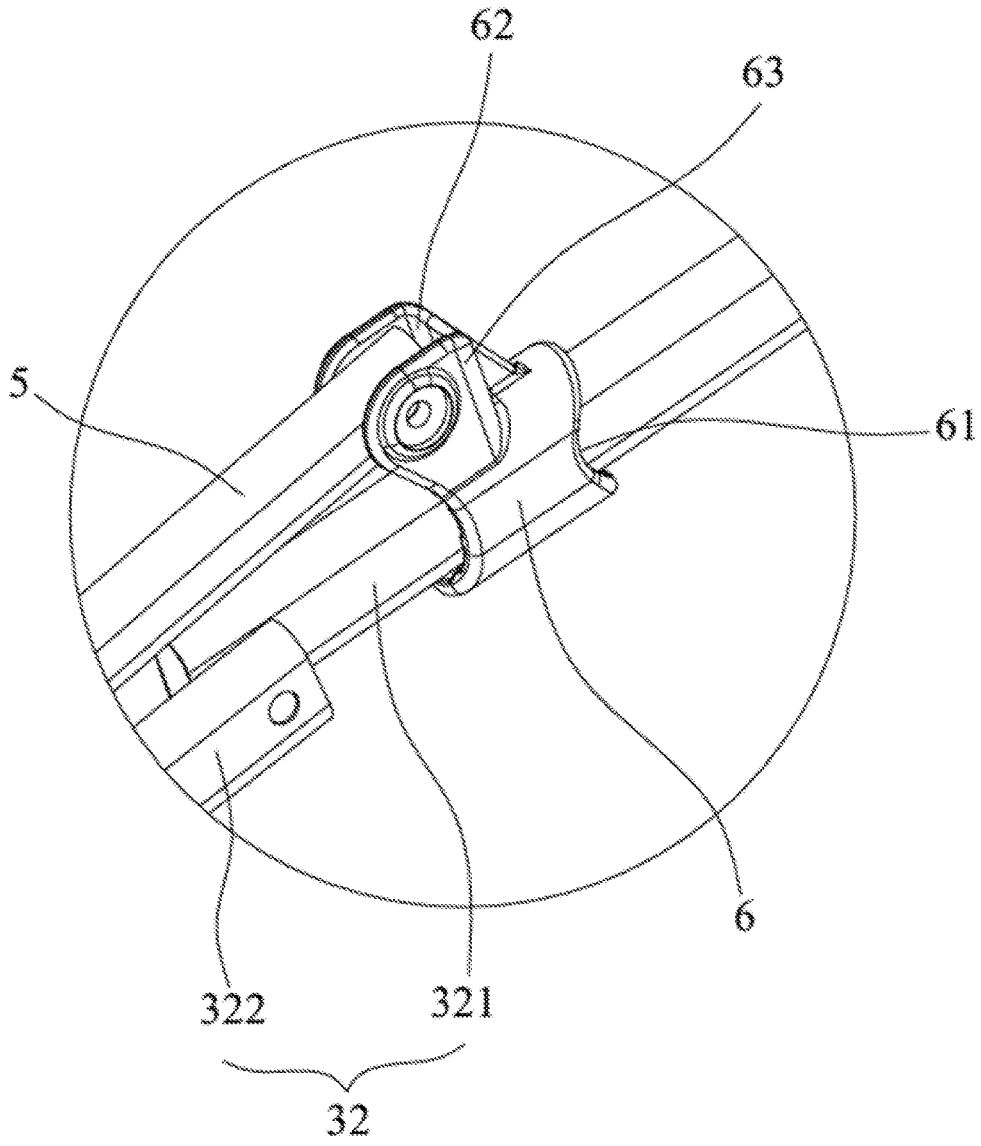
FIG. 4 is an enlarged view taken along the circle in FIG. 3.
Figure 8:
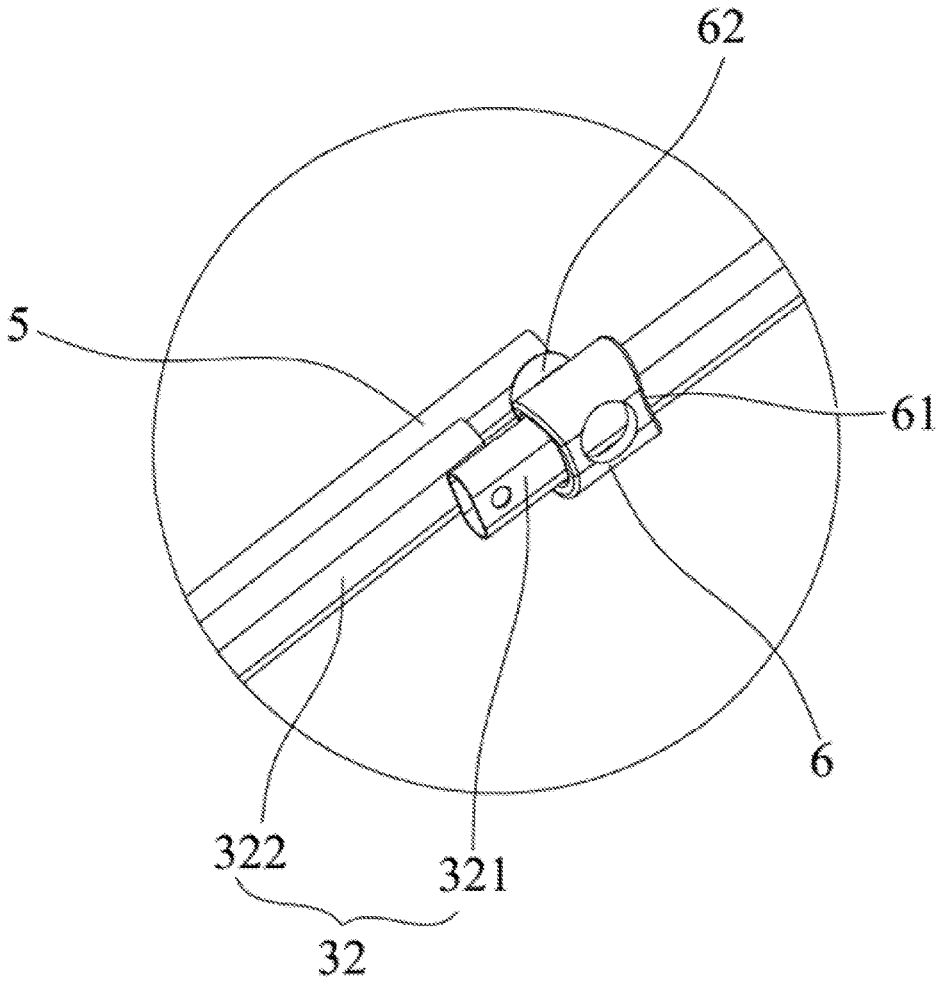
FIG. 8 is an enlarged view taken along the circle in FIG. 7.

Referring to FIG. 4 and FIG. 8, eave pole 4 has a first end portion pivotally connected with a first end portion of connecting pole 5, and a second end portion of connecting pole 5 is pivotally coupled with third connector 6 which is slidably coupled and movable along first upper pole 321. The third connector is also referred to as a sliding connector. In some embodiments, the third connector includes through hole 61 by which first upper pole 321 penetrates. Pivoting seat 63 is formed on a surface of the third connector and includes pivoting groove 62 formed therein. Furthermore, the connecting pole is pivotally disposed in the pivoting groove.

In some embodiments, a middle portion of connecting pole 5 is pivotally connected with a middle portion of second upper pole 322. In an embodiment, connecting pole 5 is pivotally connected with second upper pole 322 at a position between a pivotal position at which the first and second upper poles are connected and a pivotal point at which oblique pole 33 is connected with the second upper pole.

In some embodiments, such as the embodiment illustrated in FIG. 8, connecting pole 5 is directly coupled to an external side of pivoting seat 62, which is formed on a surface of third connector 6. In the present case, the pivoting seat is omitted. Furthermore, in many embodiments, the third connector includes at least one convex surface, and the pivoting seat is formed on the at least one convex surface.

An eave structure also includes a sleeve member such as sleeve member 13 to couple eave pole 4 with a supporting pole. Sleeve member 13 is disposed at first connector 11, and in some cases, disposed at a top of the first connector and fixedly coupled/formed with the first connector. In some embodiments, sleeve member 13 is formed with through hole 14 into which eave pole 4 is inserted. When the tent frame is unfolded, sleeve member 13 allows the second end portion of eave pole 4 to extend outwardly beyond upper pole unit 32 and/or beyond supporting pole 1.

It should be noted that a tent frame of the present invention can include a various number of eave structures, depending on the application, preference, or the like. For instance, in an embodiment where only one side of the tent needs shade, the tent frame can include two eave structures, with each eave structure connected with one of two adjacent supporting poles. In an embodiment where two sides of the tent need shade, the tent frame can include three eave structures, with each eave structure connected with one of three adjacent supporting poles. In a further embodiment where all sides of the tent need shade, the tent frame can include the same number of eave structures as the number of supporting poles, with each eave structure connected with one of the supporting poles.

The eave structure of the present invention can be folded and unfolded along with the other elements of the tent frame. For instance, referring to FIG. 3 and FIG. 7, to unfold the tent frame, pull outwardly the plurality of supporting poles 1 (e.g., away from each other). The outward pulling of the supporting poles causes each second connector 12 to move along a supporting pole toward first connector 11, which in turn unfolds the plurality of side pole units 2. The outward pulling of the supporting poles and the unfolding of the side pole units unfold upper frame 3, which in turn causes the second end portion of eave pole 4 to extend outwardly beyond upper frame 3 and/or supporting pole 1. The second connectors can then be held or locked in place to secure the position of the tent frame.

Figure 5:
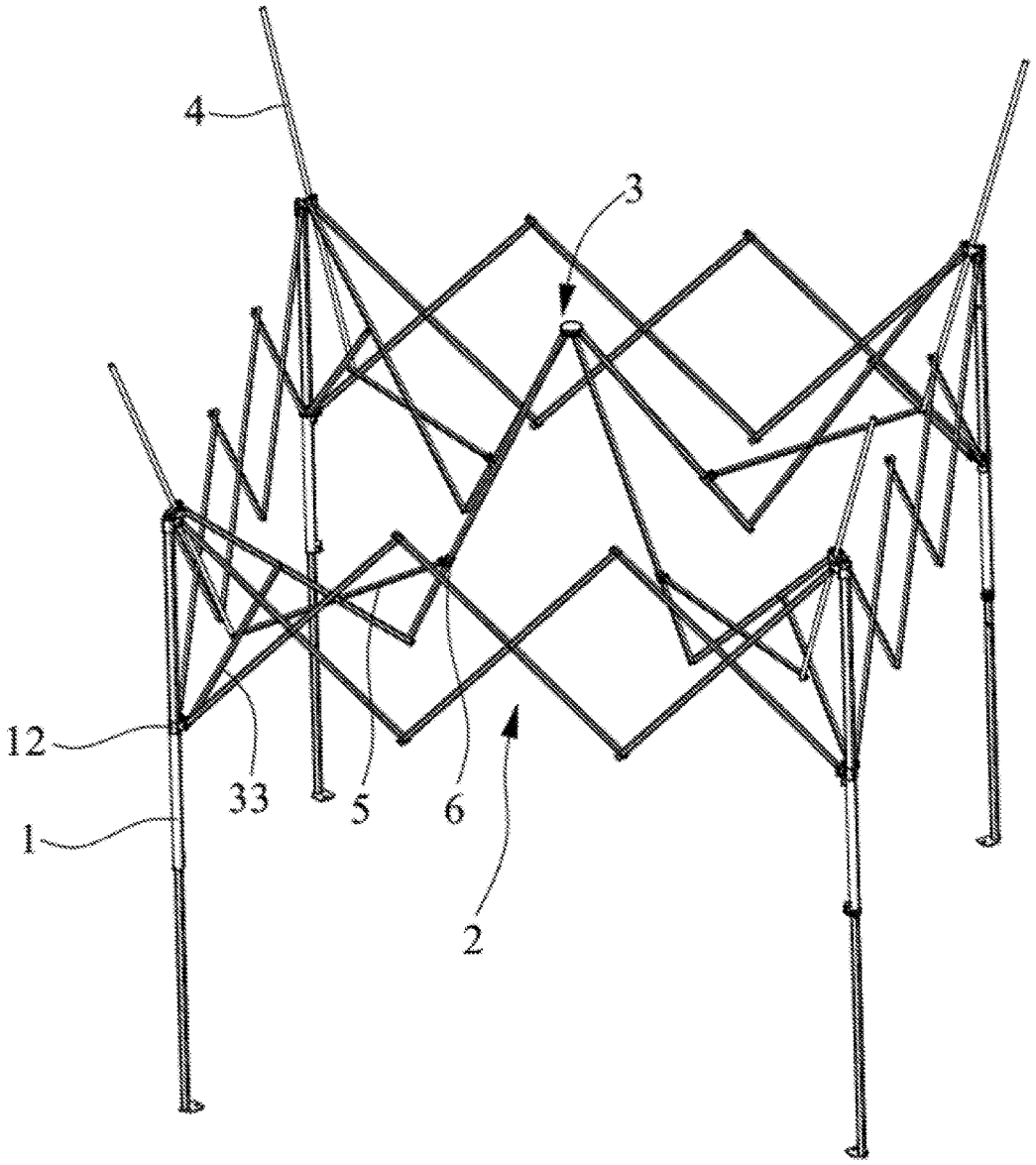
FIG. 5 is a schematic view illustrating the tent frame of FIG. 3 in a semi-folded state.
Figure 6:
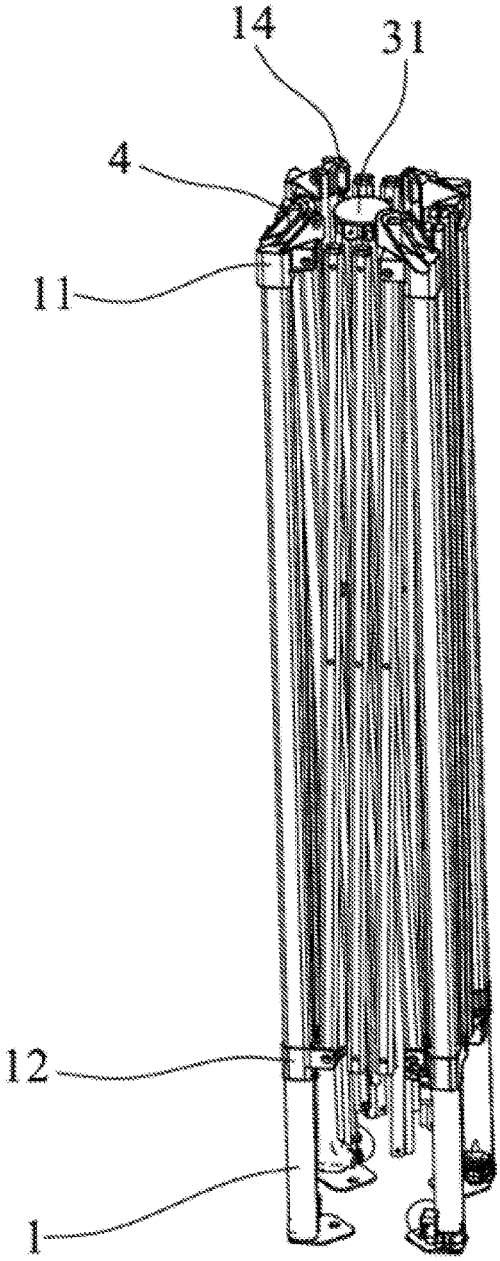
FIG. 6 is a schematic view illustrating the tent frame of FIG. 3 in a folded state.
Figure 9:
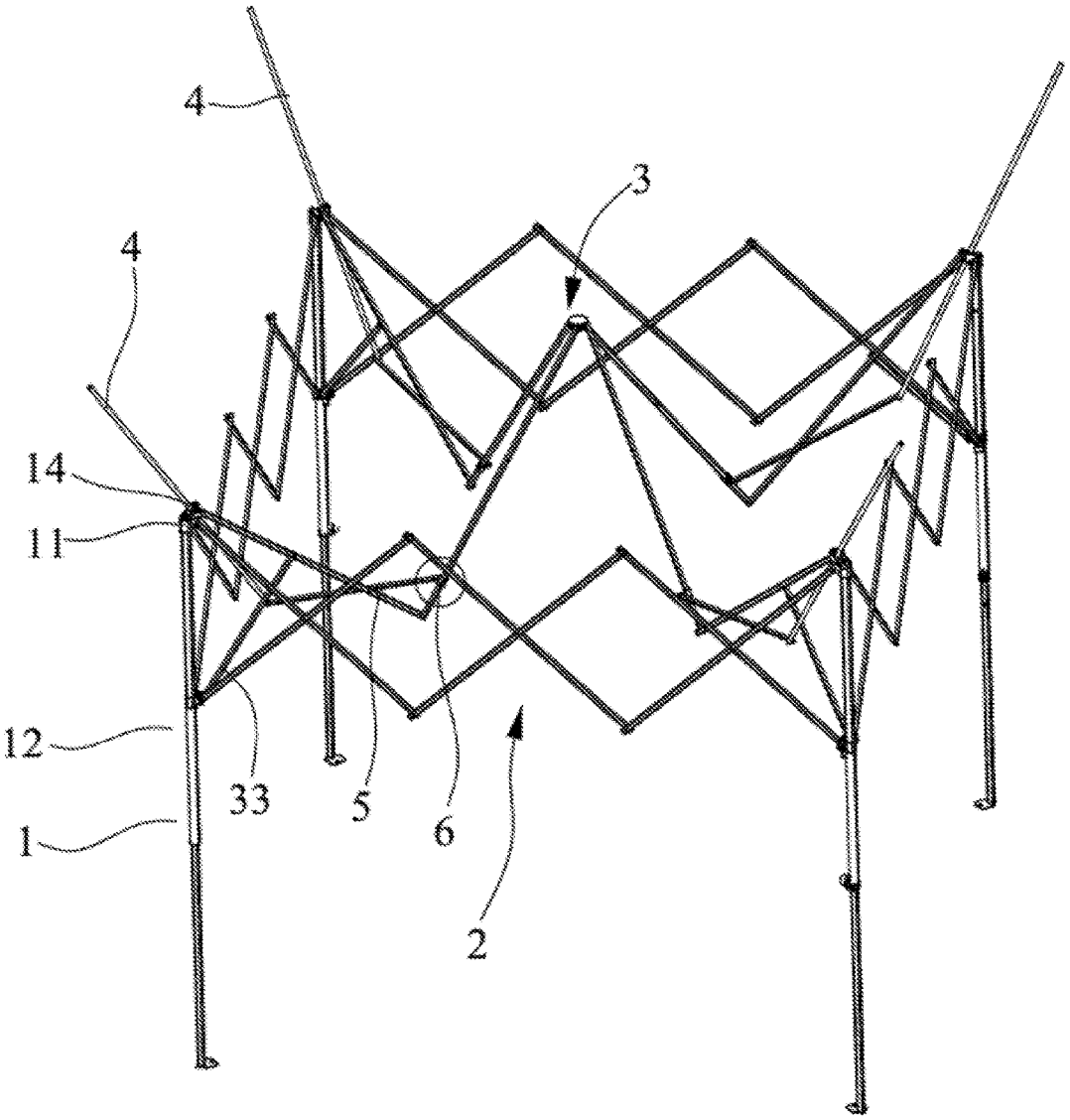
FIG. 9 is a schematic view illustrating the tent frame of FIG. 7 in a semi-folded state.

Referring to FIG. 5, FIG. 6, and FIG. 9, to fold the tent frame, unlocking second connectors 12 allows them to slide along the supporting poles. The sliding of the second connectors pulls the plurality of supporting poles inwardly toward each other and folds the plurality of side pole units. The inward pulling of the supporting poles and the folding of the side pole units folds upper frame 3, which in turn pulls the eave poles inwardly. Eventually, all the components of the tent frame are folded together as illustrated in FIG. 6.

As disclosed herein, when the tent frame is unfolded, the second end portion of eave pole 4 extends outwardly beyond the upper pole unit and the supporting pole. Thus, the eave structure of the present invention can be used to extend a tent cloth such as a canopy beyond the side(s) of the tent. As a result, the eave structure can provide a larger shaded area, and smooth out the surface of the tent cloth. Moreover, the tent frame of the present invention is convenient to use as the eave structure of the present invention ca be folded and unfolded along with other elements of the tent frame. Furthermore, the tent frame of the present invention when folded is compact, making the tent frame easy to carry and store.

For convenience in explanation and accurate definition in the appended claims, the terms "upper", "lower", "upwardly", "downwardly", and "outwardly" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An eave structure of a tent frame, wherein the tent frame comprises a supporting pole, a first upper pole, and a second upper pole, the eave structure comprising:

a sleeve member configured to be disposed at a first connector of the tent frame;

an eave pole slidably coupled with the sleeve member;

a connecting pole having a first end portion pivotally connected with a first end portion of the eave pole and a second end portion pivotally connected with a sliding connector; and the sliding connector slidably coupled with the first upper pole and movable along the first upper pole, wherein:

the first connector is fixedly coupled with an upper end portion of the supporting pole, a first end portion of the first upper pole is pivotally connected with a hub of the tent frame, a second end portion of the first upper pole is pivotally connected with a first end portion of the second upper pole, and a second end portion of the second upper pole is pivotally connected with the first connector.

2. The eave structure of claim 1, wherein the sliding connector comprises:

a through hole configured to allow the first upper pole to penetrate therethrough; and a pivoting seat comprising a pivoting groove formed on a surface of the sliding connector, wherein the second end portion of the connecting pole is pivotally disposed in the pivoting groove of the pivoting seat.

3. The eave structure of claim 2, wherein the sliding connector comprises at least one convex surface, and the pivoting seat is formed on the at least one convex surface of the sliding connector.

4. The eave structure of claim 1, wherein the sliding connector comprises:

a through hole configured to allow the first upper pole to penetrate therethrough; and a pivoting seat formed on a surface of the sliding connector, wherein the second end portion of the connecting pole is pivotally connected to an external side of the pivoting seat.

5. The eave structure of claim 4, wherein the sliding connector comprises at least one convex surface, and the pivoting seat is formed on the at least one convex surface of the sliding connector.

6. The eave structure of claim 1, wherein the sleeve member is formed with a through hole through which a second end portion of the eave pole passes therethrough.

7. The eave structure of claim 1, wherein the sleeve member is fixedly coupled with or integrally formed with the first connector at a top of the first connector.

8. The eave structure of claim 1, wherein a middle portion of the connecting pole is pivotally connected with the second upper pole at a position between the first and second end portions of the second upper pole.

9. A tent frame, comprising:

a plurality of supporting poles, each provided with a first connector and a second connector, wherein the first connector is fixedly coupled with an upper end portion of the supporting pole, and the second connector is slidably coupled with the supporting pole and movable along the supporting pole below the first connector;

a plurality of side pole units, each coupled with two adjacent supporting poles through one or more of the first and second connectors at the two adjacent supporting poles and disposed at a side of the tent frame between the two corresponding adjacent supporting poles when the tent frame is in an unfolded state;

an upper frame coupled with the plurality of supporting poles, the plurality of side pole units, or both, and comprising a hub, a plurality of upper pole units, and a plurality of oblique poles; and two or more eave structures, each corresponding to a supporting pole in a subset of the plurality of supporting poles and comprising a sleeve member, an eave pole, a connecting pole, and a third connector;

wherein corresponding to each respective supporting pole in the plurality of supporting poles:

an upper pole unit in the plurality of upper pole units comprises:

a first upper pole and a second upper pole, each having first and second end portions, the first end portion of the first upper pole is pivotally connected with the hub, the second end portion of the first upper pole is pivotally connected with the first end portion of the second upper pole, and the second end portion of the second upper pole is pivotally connected with the first connector; and an oblique pole in the plurality of oblique poles has a first end portion pivotally connected with the second upper pole at a position between the first and second end portions thereof, and a second end portion pivotally connected with the second connector;

wherein corresponding to each respective supporting pole in the subset of the plurality of supporting poles:

the sleeve member is disposed at the first connector at the respective supporting pole;

the eave pole is slidably coupled with the sleeve member at the respective supporting pole;

the connecting pole has a first end portion pivotally connected with a first end portion of the eave pole and a second end portion pivotally connected with the third connector; and the third connector is slidably coupled with and movable along the first upper pole of the upper pole unit connected with the respective supporting pole.

10. The tent frame of claim 9, wherein a number of supporting poles and a number of eave structures are the same, wherein each respective supporting pole in the plurality of supporting poles has a corresponding eave structure.

11. The tent frame of claim 9, wherein the third connector comprises:

a through hole configured to allow the first upper pole to penetrate therethrough; and a pivoting seat comprising a pivoting groove formed on a surface of the third connector, wherein the second end portion of the connecting pole is pivotally disposed in the pivoting groove of the pivoting seat.

12. The tent frame of claim 11, wherein the third connector comprises at least one convex surface, and the pivoting seat is formed on the at least one convex surface of the third connector.

13. The tent frame of claim 9, wherein the third connector comprises:

a through hole configured to allow the first upper pole to penetrate therethrough; and a pivoting seat formed on a surface of the third connector, wherein the second end portion of the connecting pole is pivotally connected to an external side of the pivoting seat.

14. The tent frame of claim 13, wherein the third connector comprises at least one convex surface, and the pivoting seat is formed on the at least one convex surface of the third connector.

15. The tent frame of claim 9, wherein the sleeve member is formed with a through hole through which the second end portion of the eave pole passes therethrough.

16. The tent frame of claim 9, wherein the sleeve member is fixedly coupled with or integrally formed with the first connector.

17. The tent frame of claim 9, wherein a middle portion of the connecting pole is pivotally connected with the second upper pole of the upper pole unit connected with the respective supporting pole at a position between the first and second end portions of the second upper pole.

18. The tent frame of claim 9, wherein a side pole unit in the plurality of side pole units comprises one or more side pole pairs connected with each other, wherein each side pole pair comprises first and second side poles crossly and pivotally connected with each other, and each of the first and second side poles adjacent a supporting pole has an end portion pivotally connected with the first or second connector at the supporting pole.

19. The tent frame of claim 18, wherein each side pole unit in the plurality of side pole units comprises three side pole pairs.

20. A tent, comprising:

a tent frame of claim 9; and a tent cloth coupled with and supported by the tent frame when the tent is unfolded.

* * * * *